United States Patent [19]

Buecher et al.

[11] 4,078,509

[45] Mar. 14, 1978

[54] SALVAGE APPARATUS AND METHOD

[75] Inventors: Roger W. Buecher; Robert T. Hoffman, both of Kailua, Hawaii

[73] Assignee: The United States of America as represented by the Secretary of the Navy, Washington, D.C.

[21] Appl. No.: 690,695

[22] Filed: May 27, 1976

[51] Int. Cl.[2] ..... B63C 7/10

[52] U.S. Cl. ..... 114/54

[58] Field of Search ..... 114/50, 52–54, 114/16 E

[56] References Cited

U.S. PATENT DOCUMENTS

| | | | |
|---|---|---|---|
| 2,413,313 | 12/1946 | Cook | 114/54 |
| 2,635,574 | 4/1953 | Sturtevant | 114/54 |
| 3,500,785 | 3/1970 | Strange | 114/50 |
| 3,512,493 | 5/1970 | Hallanger | 114/53 |
| 3,710,746 | 1/1973 | McDonald | 114/52 X |

FOREIGN PATENT DOCUMENTS

| | | | |
|---|---|---|---|
| 2,222,482 | 11/1973 | Germany | 114/54 |
| 132,934 | 10/1919 | United Kingdom | 114/54 |
| 4,510 of | 1883 | United Kingdom | 114/52 |

*Primary Examiner*—Trygve M. Blix
*Assistant Examiner*—Sherman D. Basinger
*Attorney, Agent, or Firm*—Richard S. Sciascia; Ervin F. Johnston

[57] ABSTRACT

A salvage apparatus which includes a collapsible bag which has a top and a bottom. A relief valve is mounted at the top of the bag for expelling air from the top of the bag, and a relief valve is mounted at the bottom of the bag for expelling water from the bottom of the bag. A fitting is mounted to the bag for introducing gas or water into the bag so that the rates of descent and ascent of the bag can be controlled. A method of recovering a submerged object includes filling the bag with water, attaching the bag to the submerged object, introducing gas into the bag until the object commences to ascend, and venting air from the top of the bag as the bag ascends to control the rate of ascent.

5 Claims, 6 Drawing Figures

(b)

SALVAGE APPARATUS AND METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The Navy has been increasingly involved in salvage operations. These operations include the recovery of various hardware placed on the ocean bottom as well as objects which are inadvertently dropped to the ocean bottom. The Navy has a continuing program to improve its capability and equipments for recovering submerged objects.

Salvage operations generally utilize lifting lines buoyant lift structures, or a combination of these methods. The use of buoyant lift structures, either rigid or collapsible, requires placement, attachment, and either deballasting or inflation of the buoyant body. The requirements for salvage operations at deep ocean depths have become more frequent, consequently requiring an advance in the state of the art of the equipment.

The primary problem in using buoyant recovery systems is controlling the ascent velocity once the lift has begun. This is particularly true with collapsible lift bags. If the load to be lifted is less than the bag capacity, ascent will begin before the bag has reached its maximum displacement. If the bag is closed, it will normally have folds which decrease its volume below the fully inflated volume, and if it is open, the bag will normally have both folds and water inside. In either case, as the bag ascends, the gas expands forcing out the water and/or the folds, thereby increasing the net buoyancy of the bag. As the buoyancy increases, the ascent velocity increases which can result in a very hazardous uncontrolled ascent of the object to be salvaged. Further, during a rapid ascent, a velocity head will develop at a stagnation point at the top of the bag. When this velocity head exceeds the internal pressure opposite the stagnation point the top of the bag will deform. This leads to an unstable bubble geometry at the top of the bag and will normally result in substantial horizontal excursions of the lifting bag.

Collapsible bags are often preferred to rigid pontoon type lifting devices because the former can be easily stored and transported when not in use. However, the hazardous ascent velocities of the collapsible bags have been a deterrence, which problem the present invention seeks to overcome.

SUMMARY OF THE INVENTION

The present invention provides a collapsible bag apparatus and method which is capable of lifting a submerged object with a safe controlled ascent to the surface of the ocean. This has been accomplished by providing a salvage apparatus which includes a collapsible bag having a top and a bottom. A relief valve is mounted at the top of the bag for expelling air from the top of the bag, and a relief valve is mounted at the bottom of the bag for expelling water from the bottom of the bag. A fitting is mounted to the bag for introducing air or water into the bag so that the rates of descent and ascent of the bag can be controlled. The salvage method includes filling the flexible bag with water, attaching the bag to the submerged object, introducing a gas into the bag until the object commences to ascend, and venting air from the top of the bag as the bag ascends to control the rate of ascent.

OBJECTS OF THE INVENTION

An object of the present invention is to overcome the aforementioned problems associated with prior art salvage lifting devices.

Another object is to provide a lift bag salvage apparatus which can be utilized to lift a submerged object with a controlled ascent.

Another object is to provide a controlled buoyancy lift apparatus which can be operated by a diver or from a submersible and which is collapsible for easy storage.

These and other objects of the invention will become more readily apparent from the ensuing specification when taken together with the drawings.

DESCRIPTION OF THE PREFERRED EMBODIMENT

Figure 2:
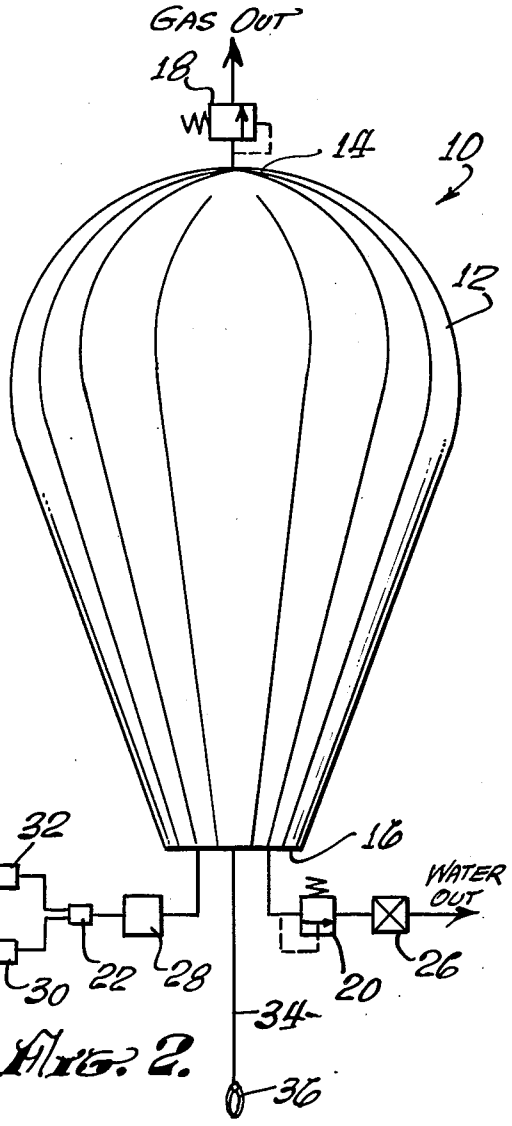
FIG. 2 is a schematic illustration of the present salvage bag apparatus.

Referring now to the drawing, wherein like reference numerals designate like or similar parts throughout the several views, there is illustrated in FIG. 2 a salvage apparatus 10 which includes a collapsible bag 12 having a top 14 and a bottom 16. A relief valve 18 is mounted at the of the bag for expelling air from the top of the bag, and a relief valve 20 is mounted at the bottom of the bag for expelling water from the bottom of the bag. A fitting 22 is mounted to the bag for receiving air or water into the bag 12 from air and water lines 23 and 24. It is preferred that the fitting 22 be mounted to the bag 12 at its bottom in proximity to the bottom relief valve 20 so as to centralize the controls for a diver or a remote vehicle.

It is necessary that the bottom relief valve 20, open under internal bag pressure before the opening of the top relief valve 18 for a purpose which will be explained hereinbelow. Further, it is desirable to have an on and off valve 26 connected in series with the bottom relief valve 20. In this manner, the on and off valve 26 may be closed while the bag is filled with water through the fitting 22, thereby causing gas to be vented through the top relief valve 18. This will ballast the bag and cause it to descend. Further, upon opening the on and off valve 26, gas can be introduced through the fitting 22 into the bag to discharge water through the relief valve 20. Because of the opening of the relief valve 20 before the relief valve 18 the deballasting will take place while all air introduced into the bag will be retained because of the closed condition of the valve 18. This will cause the bag to ascend. Valve 26 is closed during ascent, fixing the gas volume and therefore the buoyancy of the device. The line for the fitting 22 may be provided with an on and off valve 28, and the gas and water lines 23 and 24 may be provided with on and off valves 30 and 32, respectively, for controlling the ballasting and deballasting functions of the lift bag.

Figure 1:
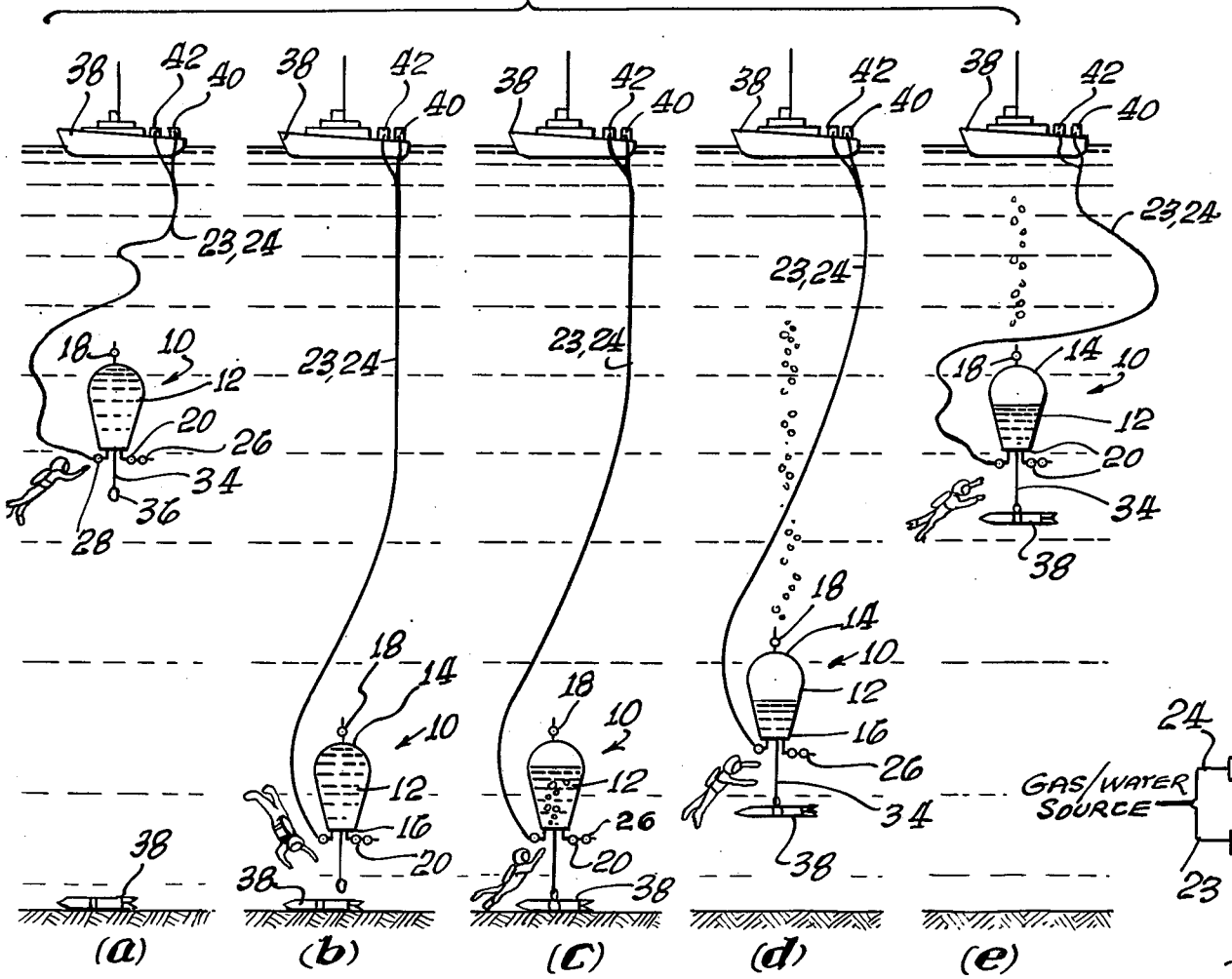
FIG. 1*a* through FIG. 1*e* illustrate the various steps and method of operation of the present invention.

The bottom of the bag may be provided with a lift line 34 which terminates in a snap ring 36 for attachment to a submerged object, such as a practice torpedo 38, as illustrated in FIG. 1. It has been found desirable to construct the lift bag from Kevlar. Kevlar has low working strains which result in very small bag volume changes over a wide range of working pressures.

OPERATION AND METHOD OF THE INVENTION

The operation and method of the invention are illustrated in FIGS. 1a through 1e. The lift bag 10 may be debarked from a surface vessel 38. This vessel may be provided with an air compressor or gas generator 40 and a water pump 42 which are connected to gas and water lines 23 and 24, respectively for deballasting and ballasting the lift bag 10. This operation may be accomplished by an underwater remote vehicle or by a diver, as shown. In FIG. 1a the diver has utilized the water line 24 and valve 32 for filling the bag 12 with water so that it will descend in the ocean. During this phase of the operation the on and off valve 26 is closed. If the bag is completely filled with water it will descend at its most rapid rate, however, a lesser rate can be attained by partially filling the bag with water, and applying a regulated gas supply as desired. When the lift bag 10 has descended to the site of the object 38 the diver completely fills the bag with water through the valve 32 until the bag is fully formed, that is until the bag is in its fully expanded condition, as illustrated in FIG. 1(b). The diver then connects the lift line 34 of the bag to the object and then utilizes the gas line 23 and valve 30 for deballasting the bag, as illustrated functionally in FIG. 1c. During this phase of the operation the valve 26 is open so that the relief valve 20 opens to allow internal water to be discharged while the relief valve 18 remains closed so as to retain all air introduced. The diver continues to deballast the bag until the object commences to lift off of the ocean bottom. The valve 26 is then closed. During ascent the expanding gas is vented from the relief valve 18 to control the rate of ascent.

Obviously, many modifications and variations of the present invention are possible in the light of the above teachings, and, it is therefore understood that within the scope of the disclosed inventive concept, the invention may be practiced otherwise than specifically described.

What is claimed is:

1. A method of recovering submerged objects at a controlled ascent rate with a flexible bag which has an openable bottom comprising the steps of:

completely filling the flexible bag with water until the bag is expanded to its full form with water only;

attaching the bag to the submerged object;

introducing a gas into the bag until the object commences to ascend;

closing off the bottom of the bag so as to maintain the full form of the bag and prevent discharge of water as the bag ascends in the water; and venting air from the bag as the bag ascends to control the rate of ascent thereof.

2. A method of recovering submerged objects at a controlled ascent rate comprising the steps of:

providing a flexible bag which has a top and a bottom, the top of the bag having an outlet and the bottom of the bag having an inlet and an outlet;

placing the bag in a body of water where the submerged object is located;

completely filling the flexible bag with water by forcing the water under pressure through the bag's bottom inlet until the bag is fully formed with water only;

venting any air in the bag through the top of the bag as the bag is being fully formed with water;

attaching the bag to the submerged object;

introducing air into the bag through the bottom inlet and simultaneously discharging water through the bottom outlet and retaining all air introduced so as to maintain the fully formed condition of the bag until the object commences to ascend;

closing off the bottom outlet; and venting air through the top outlet as the bag and object ascend so as to control the rate of ascent.

3. A salvage apparatus comprising:

a collapsible bag having a top and a bottom;

a relief valve mounted at the top of the bag for expelling air from the top of the bag;

a relief valve mounted at the bottom of the bag for expelling water from the bottom of the bag;

an on and off valve connected in series with the bottom relief valve;

a fitting mounted to the bag for introducing air or water into the bag, whereby rates of descent and ascent of the bag can be controlled.

4. A salvage device as claimed in claim 3 including:

the bottom relief valve being set to open under internal bag pressure before the opening of the top relief valve so as to permit deballasting of water from the bag through the bottom relief valve while the top relief valve remains closed.

whereby positive buoyancy of the bag can be established while maintaining the fully formed condition of the bag.

5. A salvage device as claimed in claim 4 including:

the bag being substantially inelastic.

* * * * *